United States Patent [19]

Ohki et al.

[11] Patent Number: 4,584,264

[45] Date of Patent: Apr. 22, 1986

[54] COLOR PHOTOGRAPHIC LIGHT-SENSITIVE MATERIALS

[75] Inventors: Nobutaka Ohki; Yoshinobu Yoshida, both of Kanagawa, Japan

[73] Assignee: Fuji Photo Film Co., Ltd., Kanagawa, Japan

[21] Appl. No.: 735,925

[22] Filed: May 20, 1985

Related U.S. Application Data

[63] Continuation of Ser. No. 606,487, May 3, 1984, abandoned.

[30] Foreign Application Priority Data

May 4, 1983 [JP] Japan ..... 58-78606

[51] Int. Cl.[4] ..... G03C 7/26

[52] U.S. Cl. ..... 430/542; 430/372; 430/551

[58] Field of Search ..... 430/372, 551, 542

[56] References Cited

U.S. PATENT DOCUMENTS

| | | | |
|---|---|---|---|
| 3,930,866 | 1/1976 | Oishi et al. | 430/551 |
| 4,175,968 | 11/1979 | Credner et al. | 430/372 |
| 4,198,239 | 4/1980 | Credner et al. | 430/372 |
| 4,277,558 | 7/1981 | Kikuchi et al. | 430/372 |
| 4,366,226 | 12/1982 | Hamaoka et al. | 430/372 |
| 4,447,523 | 5/1984 | Ross et al. | 430/551 |
| 4,474,874 | 10/1984 | Hirano et al. | 430/551 |

*Primary Examiner*—J. Travis Brown

*Attorney, Agent, or Firm*—Sughrue, Mion, Zinn, Macpeak and Seas

[57] ABSTRACT

A silver halide color photographic light-sensitive material containing a compound of the general formula (I) as a color stain inhibitor:

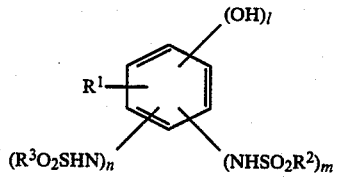

(I)

$R^1$, $R^2$, $R^3$, l, m and n are as defined herein. This color stain inhibitor has various advantages and is capable of efficiently removing oxidized color developing agents, can be used in light-sensitive materials with reduced layer thickness, and is free from changes in performance even after a long-term storage.

10 Claims, No Drawings

COLOR PHOTOGRAPHIC LIGHT-SENSITIVE MATERIALS

This is a continuation of application Ser. No. 06/606,487, filed May 3, 1984, now abandoned.

FIELD OF THE INVENTION

The present invention relates to color photographic light-sensitive materials in which the formation of color stain is prevented. More particularly, it is concerned with silver halide color photographic light-sensitive materials containing sulfonamidophenol derivatives as color stain inhibitors.

BACKGROUND OF THE INVENTION

It is well known that in multilayer color photographic light-sensitive materials of the type that silver halide photographic light-sensitive emulsions contain color formers or couplers and development is accomplished using color developers such as paraphenylenediamine, oxidation products of color developing agents or oxidized color developing agents as formed during the process of development migrate into adjacent image-forming undesirable dyes, i.e., causing the so-called "color turbidity (color mixing)" phenomenon. It is also known that aerial oxidation of color developing agents, fogging of emulsions, and so forth, arising in the process of color development cause undesirable "color fog" phenomenon. The term "color stain" is used herein to include both "color turbidity" and "color fog".

In order to prevent the formation of color stain, use of hydroquinones has been proposed. Various types of hydroquinones have been disclosed, including monostraight chain alkylhydroquinones as described in, for example, U.S. Patent 2,728,657 and Japanese Patent Application (OPI) No. 106329/72 (the term "OPI" as used herein means a "published unexamined Japanese patent application"), monobranched chain alkylhydroquinones as described in, for example, U.S. Pat. No. 3,700,453, West German Patent Laid-Open No. 2,149,789, Japanese Patent Application (OPI) Nos. 156438/75 and 106329/74, di-straight chain alkylhydroquinones as described in, for example, U.S. Pat. Nos. 2,728,657, 2,732,300, British Patent Nos. 752,146, 1,086,208, and *Chemical Abstract*, Vol. 58, 6367h, and di-branched chain alkylhydroquinones as described in, for example, U.S. Pat. Nos. 3,700,453, 2,732,300, British Patent No. 1,086,208, the above-described *Chemical Abstract*, Japanese Patent Application (OPI) Nos. 156438/75, 21249/75, and 40818/81.

The use of alkylhydroquinones as antistain agents is described also in British Patent Nos. 558,258, 557,750 (corresponding to U.S. Pat. No. 2,360,290), 557,802, 731,301 (corresponding to U.S. Pat. No. 2,701,197), U.S. Pat. Nos. 2,336,327, 2,403,721, 3,528,333, West German Patent Laid-Open No. 2,505,016 (corresponding to Japanese Patent Application (OPI) No. 110337/75), and Japanese Patent Publication No. 40816/81.

It is known that even in color diffusion transfer photographic light-sensitive materials, the "color turbidity" phenomenon occurs as in the usual color photographic light-sensitive materials. To prevent the formation of "color turbidity", hydroquinones as described above are utilized. For example, Japanese Patent application (OPI) No. 21249/83 discloses hydroquinones for use as color turbidity inhibitors for diffusion transfer light-sensitive materials.

Sulfonamidophenols are known as color turbidity inhibitors for diffusion transfer light-sensitive materials, as described in *Research Disclosure*, 15162 (1973), page 83. Japanese Patent Application (OPI) Nos. 72158/80, and 24941/82 (corresponding to U.S. Pat. No. 4,366,226).

In order to obtain high quality photographs, it has recently been strongly desired to develop novel color stain inhibitors which are capable of more efficiently preventing the formation of color stain without reducing photographic sensitivity, which can be added to light-sensitive materials with reduced layer thickness for the purpose of increasing sharpness, which are free from any variation in performance even after storage for long periods of time, and further which can contribute to an improvement in the light-fastness of dye images formed by color development.

SUMMARY OF THE INVENTION

An object of the invention is to provide novel color stain inhibitors.

Another object of the invention is to provide novel color stain inhibitors which are capable of efficiently removing color developing agents or electron transfer type black developing agents in oxidizing form.

A further object of the invention is to provide novel color stain inhibitors which can be used in light-sensitive materials with reduced layer thickness.

Another object of the invention is to provide novel color stain inhibitors which are not subject to variations in performance even after storage for long periods of time.

Still another object of the invention is to provide color photographic light-sensitive materials containing the novel color stain inhibitors.

It has been found that the objects are attained by using the compounds of the general formula (I) as described hereinafter, or incorporating the compounds of the general formula (I) into silver halide color photographic light-sensitive materials.

The present invention thus provides a silver halide color photographic light-sensitive material containing a compound of the general formula (I) as a color stain inhibitor.

Formula (I)

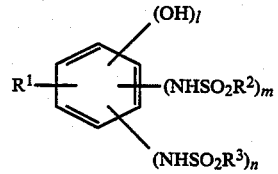

(I)

DETAILED DESCRIPTION OF THE INVENTION

In the general formula (I), $R^1$ is a hydrogen atom, a halogen atom (e.g., chlorine, bromine, and fluorine), an alkyl group which may be substituted with, for example, a halogen atom, a hydroxyl group, and an alkoxyl group and the total number of carbon atoms of which is preferably from 1 to 20 (e.g., a methyl group, an ethyl group a tert-butyl group, and a n-pentadecyl group), an alkoxyl group which may be substituted with, for example, a halogen atom, a hydroxyl group, and an aryl group, and the total number of carbon atoms of which is preferably from 1 to 20 (e.g., a methoxy group, an ethoxy group, and a butoxy group), an acylamino group in which the acyl group may be substituted with, for example, an alkyl group and an aryl group, and the total number of carbon atoms of which is preferably from 2 to 30 (e.g., an acetylamino group, a benzoylamino group, and an 60 -(2,4-di-tertamylphenoxy)propaneamido group), an alkylthio group which may be substituted with, for example, a halogen atom, a hydroxyl group, and an alkoxyl group, and the total number of carbon atoms of which is preferably from 1 to 20 (e.g., a methylthio group and a hexadecylthio group), an alkoxycarbonyl group in which the alkoxyl group may be substituted with, for example, a halogen atom, a hydroxyl group, and an aryl group, and the total number of carbon atoms of which is preferably from 2 to 20 (e.g., a methoxycarbonyl group and an ethoxycarbonyl group), an aryloxycarbonyl group in which the aryl group may be substituted with, for example, an alkyl group and an alkoxyl group and the total number of carbon atoms of which is preferably from 7 to 30 (e.g., a phenoxycarbonyl group), a sulfamoylamino group in which the sulfamoyl group may be substituted with, for example, an alkyl group and an aryl group, and the total number of carbon atoms of which is preferably from 0 to 20 (e.g., a $NH_2SO_2NH$— group and an N,N-dipropylsulfamoylamino group), a carbamoylamino group in which the carbamoyl group may be substituted with, for example, an alkyl group and an aryl group, and the total number of carbon atoms of which is preferably from 1 to 20 (e.g., a $NH_2CONH$— group and an N-phenylcarbamoylamino group), an arylsulfonamido group in which the aryl group may be substituted with, for example, an alkoxyl group and an alkyl group, and the total number of carbon atoms of which is preferably from 6 to 30 (e.g., a 4-(n-dodecyloxy)phenylsulfonamido group, a p-tolylsulfonamido group, and a 4-dodecylphenylsulfonamido group), an alkylsulfonamido group in which the alkyl group may be substituted with, for example, a halogen atom, a hydroxyl group, and an alkoxyl group, and the total number of carbon atoms of which is preferably from 1 to 20 (e.g., a methanesulfonamido group and a n-octanesulfonamido group), an acyl group preferably containing an alkyl or aryl group having from 1 to 20 carbon atoms (e.g., an acetyl group and an ethylcarbonyl group), a sulfonyl group preferably containing an alkyl or aryl group having from 1 to 30 carbon atoms (e.g., a p-toluenesulfonyl group), or a carbamoyl group preferably containing an alkyl group having from 1 to 30 carbon atoms or an aryl (e.g., a di-n-octylcarbamoyl group), $R^2$ and $R^3$ are each an aryl group which may be substituted with, for example, a halogen atom, an alkyl group, and an alkoxyl group, and the total number of carbon atoms of which is preferably from 6 to 30 (e.g., a 4-(n-dodecyloxy)phenylgroup, a p-tolyl group, a 3,4-di-chlorophenyl group, and a 4-dodecylphenyl group), an alkyl group which may be substituted with, for example, a halogen atom, a hydroxyl group, an aryloxy group, and an alkoxyl group, and the total number of carbon atoms of which is preferably from 1 to 30 carbon atoms (e.g., a methyl group, a trifluoromethyl group, a n-hexadceyl group, and a 1-(m-pentadecylphenoxy)propyl group), or an amino group which may be substituted with, for example, an alkyl group and an aryl group, and the total number of carbon atoms of which is preferably from 0 to 30 (e.g., a dimethylamino group, and a dipropylamino group), and they may be the same or different.

l is an integer of 2 or more, m is an integer of 1 or more, and n is an integer of 0 or more, provided that the sum of l, m and n is 5 or less.

The substituents on the benzene nucleus in the general formula (I) may be located at any positions on the nucleus.

In the general formula (I), it is particularly preferred for the total number of carbon atoms of $R^1$, $R^2$ and $R^3$ to be at least 10, since the diffusion from a layer in which it has been incorporated is reduced.

Of the compounds represented by the general formula (I), those having the following general formulae (II) to (IV) are preferred.

Formula (II)

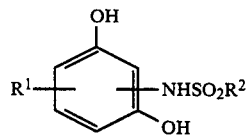

(II)

Formula (III)

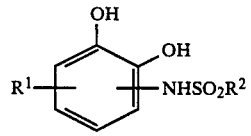

(III)

Formula (IV)

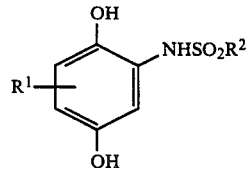

(IV)

In the above general formulae (II) to (IV), $R^1$ and $R^2$ are as defined in the general formula (I).

Of the compounds of the general formulae (II) and (III), those are preferred in which $R^1$ is a hydrogen atom, an alkyl group, an acylamino group, an alkoxycarbonyl group, an aryloxycarbonyl group, a sulfamoylamino group, a carbamolylamino group, an acyl group, a sulfonyl group, and a carbamoyl group. In the general formula (III), it is especially preferred for $R^2$ to be an amino group. In the general formula (II), it is particularly preferred for the —$NHSO_2R^2$ group to be substituted in the 6-position of the resorcine nucleus. Of the compounds of the general formula (IV), those are preferred in which $R^1$ is a hydrogen atom, a halogen atom, an alkoxycarbonyl group, an aryloxycarbonyl group, an acyl group, a sulfonyl group, and a carbamoyl group.

The amount of the color stain inhibitor of the formula (I) is $1.0\times10^{-3}$ to $1.0\times10^{-6}$ mole per square meter.

When the compounds of the present invention are incorporated in an intermediate layer as color turbidity inhibitors, it is preferred for them to be present in an amount of from $1.0\times10^{-3}$ to $1.0\times10^{-5}$ mole per square meter of the layer. When they are incorporated in an emulsion layer as color fog inhibitors, it is preferred for them to be used in an amount of from $1.0\times10^{-4}$ to $1.0\times10^{-6}$ mole per square meter of the layer. It is to be noted, however, that the present invention is not limited to the above-described values. It is also possible for the compounds of the present invention to be present in both the intermediate layer and the emulsion layer so that they serve to prevent both color turbidity and color fog.

Of the compounds of the general formulae (II) to (IV), those represented by the general formula (II) and (IV) are especially preferred. Most preferred are the compounds of the general formula (II).

Representative examples of the compounds of the general formula (I) are shown below, although the present invention is not to be construed as being limited thereto.

(1)

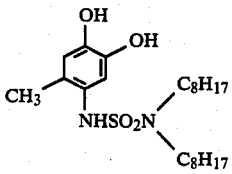

(2)

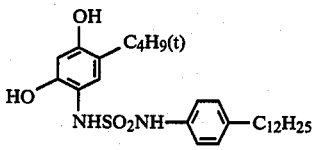

(3)

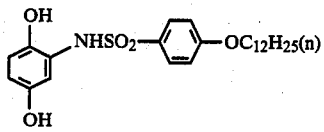

(4)

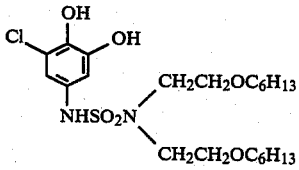

(5)

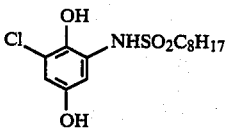

(6)

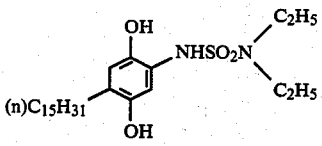

(7)

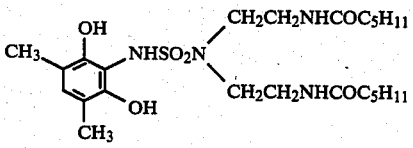

(8)

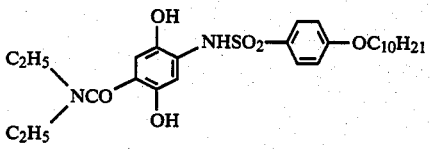

-continued (9)

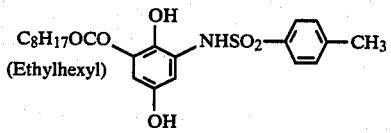

(10)

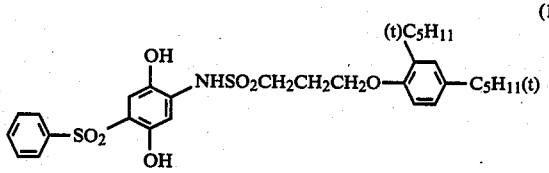

(11)

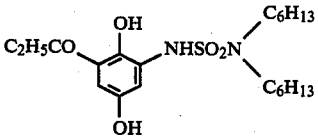

(12)

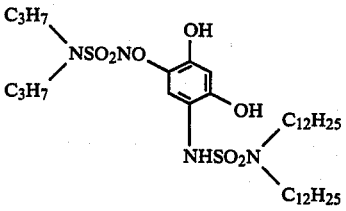

(13)

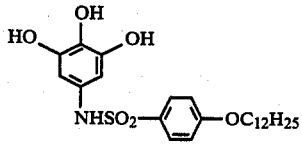

(14)

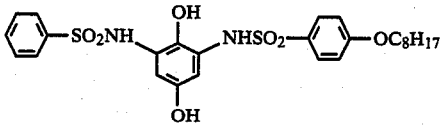

(15)

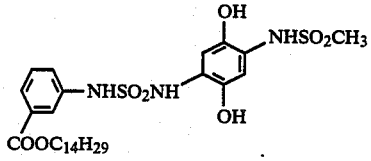

(16)

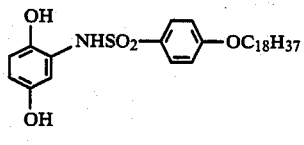

(17)

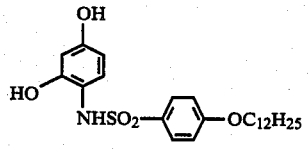

(18)

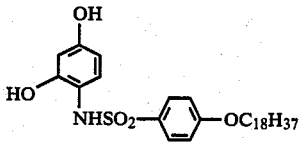

-continued (19)

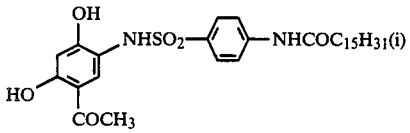

(20)

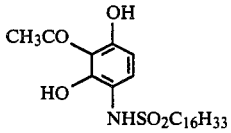

(21)

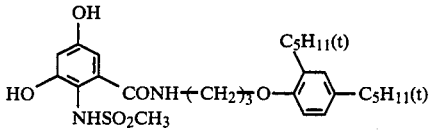

(22)

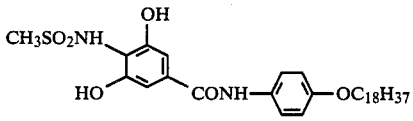

(23)

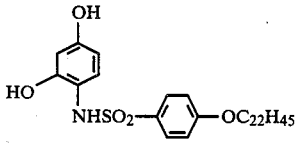

The compounds used in the present invention can be generally prepared by amidation of polyhydroxyanilines with sulfonyl halide or sulfamoyl halide as is shown below.

When n is 0;

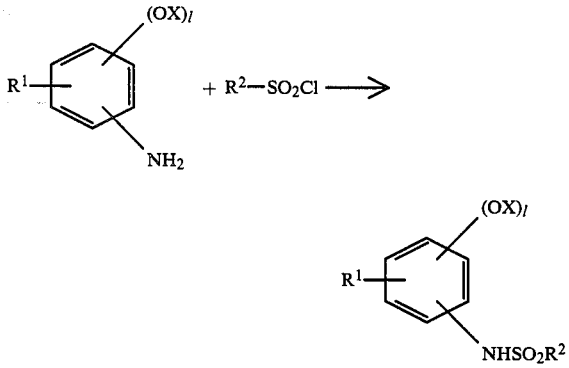

When n is 1;

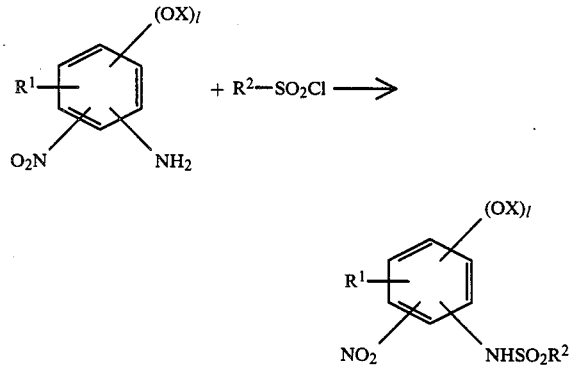

-continued

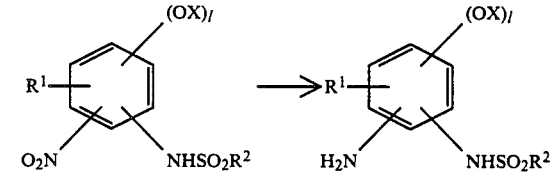

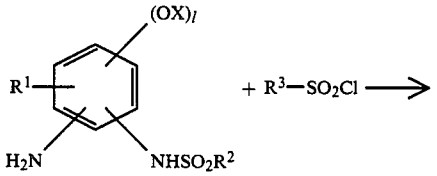

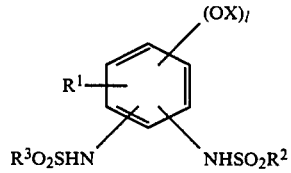

In the above formulae, $R^1$, $R^2$ and $R^3$ are the same as defined in the general formula (I). X is a group known as a protective group for hydrogen or a hydroxyl group (e.g., a benzyl group). If necessary, this protective group can be introduced prior to the reaction and removed after the reaction is completed. $R^2$—Cl and $R^3$—Cl are acid chlorides derived from acids containing $R^2$ and $R^3$ radicals, respectively.

The reaction in the case of n being 0 and the first and second reactions in the case of n being 1 as described above are each an amidation reaction between aniline and acid chloride. This reaction is generally carried out in non-protonic polar solvents (e.g., acetonitrile, dimethylformamide, and dimethylacetamide) in the presence of acidremoval agents (e.g., triethylamine, pyridine, 4-(dimethylamino)pyridine, and 1,8-Diazabicyclo[5,4,0]undec-7-ene). However, in a case where X is hydrogen, the acid-removing agent is preferably a reagent of low basicity (e.g., pyridine) in order to obtain high reaction selectivity. The reaction temperature is preferably from 0° C. to the reflux temperature of the solvent used.

The second reaction is a reduction reaction of a nitro group into an amino group. This reaction can be generally carried out by catalytic hydrogenation using hydrogen or reduction using metals (e.g., tin and iron).

Examples of the preparation of some of the compounds of the present invention are shown below. Unless otherwise indicated herein, all parts, percents, ratios and the like are by weight.

PREPARATION EXAMPLE 1

Preparation of Compound (3)

Aminohydroquinone hydrochloride (8.1 g) prepared from nitrohydroquinone by the Henrich method described in Ber., 54, 2506 (1921) and 7 ml of triethylamine were dissolved in 80 ml of pyridine in a stream of nitrogen, and 18.1 g of 4-dodecyloxybenzenesulfonyl chloride was added thereto. The mixture was refluxed for 1 hour and then was allowed to cool and gradually poured with stirring into 500 ml of ice water containing 100 ml of concentrated hydrochloric acid. Crystals precipitated were collected by filtration, washed with water, dried and then purified by column chromatography to yield 16 g of light brown crystals.

| Elemental analysis: | C | H | N |
|---|---|---|---|
| Calculated for $C_{24}H_{35}NO_5S$ (%) | 64.11 | 7.85 | 3.12 |
| Found (%) | 63.87 | 7.81 | 3.08 |

cl PREPARATION EXAMPLE 2

Preparation of Compound (16)

The procedures of Preparation Example 1 above were repeated wherein 22.3 g of 4-octadecyloxybenzenesulfonyl chloride was used in place of 4-dodecyloxybenzenesulfonyl chloride, yielding 21 g of the desired product, Compound (16), m.p., 117°–118° C.

| Elemental analysis: | C | H | N |
|---|---|---|---|
| Calculated for $C_{30}H_{47}NO_5S$ (%) | 67.50 | 8.87 | 2.62 |
| Found (%) | 67.27 | 8.95 | 2.54 |

PREPARATION EXAMPLE 3

Preparation of Compound (17)

4-Aminoresorcin hydrochloride (8.1 g) and 7 ml of triethylamine were dissolved in 80 ml of pyridine in a stream of nitrogen, and 18.1 g of 4-dodecyloxybenzenesulfonyl chloride was added thereto. The mixture was stirred for 1 hour, and then gradually poured into 500 ml of ice water containing 100 ml of concentrated hydrochloric acid. Crystals precipitated were collected by filtration, washed with water, dried, and recrystallized from acetonitrile by the use of activated carbon to yield 15 g of the desired product, Compound (17), m.p., 148.5°–150° C.

PREPARATION EXAMPLE 4

Preparation of Compound (18)

The procedures of Preparation Example 3 above were repeated wherein 22.3 g of 4-octadecyloxybenzenesulfonyl chloride was used in place of 4-dodecyloxybenzenesulfonyl chloride, yielding 19 g of the desired product, Compound (18), m.p., 131°–133° C.

PREPARATION EXAMPLE 5

Preparation of Compound (23)

The procedures of Preparation Example 3 above were repeated wherein 25.1 g of 4-docosyloxybenzenesulfonyl chloride was used in place of 4-dodecyloxybenzenesulfonyl chloride, yield 25.1 g of the desired product, Compound (23), m.p., 78°–80° C.

In incorporating the compounds of the present invention into the layers of the light-sensitive material of the present invention, such as an emulsion layer and an intermediate layer, known procedures commonly used in introducing couplers into emulsion layers can be employed. For example, the compounds of the present invention can be dissolved in solvents such as phthalic acid alkyl esters (e.g., dibutyl phthalate and dioctyl phthalate), phosphoric acid esters (e.g., diphenyl phosphate, triphenyl phosphate, tricresyl phosphate, and dioctylbutyl phosphate), citric acid esters (e.g., tributyl acetylcitrate), benzoic acid esters (e.g., octyl benzoate), alkylamides (e.g., diethyllaurylamide), fatty acid esters (e.g., dibutoxyethyl succinate and dioctyl azelate), and trimesic acid esters (e.g., tributyl trimesicate), or organic solvents having a boiling point ranging between about 30° and 150° C., such as lower alkyl acetates (e.g., ethyl acetate and butyl acetate), ethyl propionate, sec-butyl alcohol, methyl isobutyl ketone, β-ethoxyethyl acetate, and methyl Cellosolve acetate, and then dispersed in hydrophilic colloids. The above-described high-boiling and low-boiling organic solvents may be used in combination with each other, if desired.

The color stain inhibitors of the present invention are very effective in preventing the formation of color stain in silver halide color photographic light-sensitive materials (e.g., color papers, color negative films, and color reversal films) of the type where color images are formed by oxidative coupling of aromatic primary amine developers (e.g., phenylenediamine derivatives and aminophenol derivatives) with color-forming couplers during the process of color development.

Suitable color-forming couplers which can be used in color photographic light-sensitive materials of the above-described type include: as magenta couplers, 5-pyrazolone coupler, a pyrazolonebenzimidazole coupler, a cyanoacetylcumarone coupler, and an open-chain acylacetonitrile coupler; as yellow couplers, an acylacetamide coupler (e.g., benzoylacetanilides and pivaloylacetanilides), etc.; and as cyan couplers, a naphthol coupler and a phenol coupler. These couplers can be rendered nondiffusible by introducing a hydrophobic group called a ballast group into the molecule thereof, or by linking to a polymer chain. Such nondiffusible couplers are preferably used in the present invention.

The couplers may be four-equivalent or two-equivalent relative to silver ion. Moreover, they may be colored couplers having the effect of color correction, or couplers releasing a development inhibitor upon development (the so-called DIR couplers).

Typical examples of magenta couplers which can be used are described in, for example, U.S. Pat. Nos. 2,600,788, 2,983,608, 3,062,653, 3,127,269, 3,311,476, 3,419,391, 3,519,429, 3,558,319, 3,582,322, 3,615,506, 3,834,908, 3,891,445, West German Patent No. 1,810,464, West German Patent Application (OLS) Nos. 2,408,665, 2,417,945, 2,418,959, 2,424,467, Japanese Patent Publication No. 6031/65, Japanese Patent Application (OPI) Nos. 20826/76, 58922/77, 129538/74, 74027/74, 159336/75, 42121/77, 74028/74, 60233/75, 26541/76 and 55122/78.

Typical examples of yellow couplers which can be used are described in, for example, U.S. Pat. Nos. 2,875,057, 3,265,506, 3,408,194, 3,551,155, 3,582,322, 3,725,072, 3,891,445, West German Patent No. 1,547,868, West German Patent Laid-Open Nos. 2,219,917, 2,261,361, 2,414,006, British Patent No. 1,425,020, Japanese Patent Publication No. 10783/76, Japanese Patent Application (OPI) Nos. 26133/72, 73147/73, 102636/76, 6341/75, 123342/75, 130442/75, 21827/76, 87650/75, 82424/77, and 115219/77.

Typical examples of cyan couplers which can be used are described in, for example, U.S. Pat. Nos. 2,369,929, 2,434,272, 2,474,293, 2,521,908, 2,895,826, 3,034,892, 3,311,476, 3,458,315, 3,476,563, 3,583,971, 3,591,383, 3,767,411, 4,004,929, West German Patent Application (OLS) Nos. 2,414,830, 2,454,329, Japanese Patent Application (OPI) Nos. 59838/73, 26034/76, 5055/73, 146828/76, 69624/77, and 90932/77.

Those compounds as described in, for example, U.S. Pat. Nos. 3,476,560, 2,521,908, 3,034,892, Japanese Patent Publication Nos. 2016/69, 22335/63, 11304/67, 32461/69, Japanese Patent Application (OPI) Nos. 26034/76, 42121/77, and West German Patent Application (OLS) No. 2,418,959 can be used as colored couplers.

Those compounds as described in, for example, U.S. Pat. Nos. 3,227,554, 3,617,291, 3,701,783, 3,790,384, 3,632,345, West German Patent Application (OLS) Nos. 2,414,006, 2,454,301, 2,454,329, British Patent 953,454, Japanese Patent Application (OPI) Nos. 69624/77, 122335/74, and Japanese Patent Publication No. 16141/76 can be used as DIR couplers.

The color stain inhibitors of the present invention are also effective in preventing the formation of color stain in silver halide color photographic light-sensitive materials of the so-called diffusion transfer type. Dye image-forming couplers which can be used in light-sensitive materials of this type include dye developing agents, dye releasing redox compounds, and DDR couplers. More specifically, for example, the compounds described in U.S. Pat. Nos. 4,053,312, 4,055,428, 4,076,529, 4,152,153, 4,135,929, Japanese Patent Application (OPI) Nos. 149328/78, 104343/76, 46730/78, 130122/79, 3819/78, Japanese Patent Application Nos. 89128/79, 90806/79, and 91187/79 can be used.

The color stain inhibitors of the present invention can be used in combination with known color stain inhibitors such as hydroquinone derivatives, aminophenol derivatives, gallic acid derivatives, and ascorbic acid derivatives.

Typical examples of known color stain inhibitors which can be used are described in, for example, U.S. Pat. Nos. 2,360,290, 2,336,327, 2,403,721, 2,418,613, 2,675,314, 2,701,197, 2,704,713, 2,728,659, 2,732,300, 2,735,365, Japanese Patent Application (OPI) Nos. 92988/75, 92989/75, 93928/75, 110337/75, 146235/77, and Japanese Patent Publication No. 23813/75.

The light-sensitive material of the present invention may contain ultraviolet absorbents in a hydrophilic colloid layer thereof. Ultraviolet absorbents which can be used include benzotriazole compounds substituted with an aryl group, 4-thiazolidone compounds, benzophenone compounds cinnamic acid ester compounds, butadiene compounds, and benzooxazole compounds. In addition, ultraviolet lightabsorbing polymers can be used. These ultraviolet absorbents may be included in the above-described hydrophilic colloid layer.

Silver halide photographic emulsions and methods of preparation thereof, photographic additives (or photographic elements), and so forth which can be used in the lightsensitive material of the present invention are described in *Research Disclosure,* No. 176 (December 1978), sections 22–31, "Preparation and Types of Emulsions", "Rinsing of Emulsions", "Chemical Sensitization", "Spectral Sensitization", "Antifoggants and Stabilizers", "Hardening Agents", "Supports", "Plasticizers and Lubricants", "Coating Aids", "Matting Agents", "Sensitizers", "Methods of Addition", "Absorption and Filter Dyes", "Coating Methods", and so forth.

In forming color images, the procedures such as the negative/positive process (as described in, for example, *Journal of the Society of Motion Picture and Television Engineers,* Vol. 61 (1953), pages 667–701), the color reversal process in which a negative silver image is first formed by developing with a developer containing a black and white developing agent, is then subjected to at least one uniform exposure or other suitable fogging treatment, and subsequently is color-developed to obtain a dye positive image, and the silver dye bleach process in which a photographic emulsion layer containing a dye is exposed and then developed to form a silver image and, thereafter, with the silver image as a bleaching catalyst, the dye is bleached can be employed.

In general, a color developer is an alkaline aqueous solution containing color developing agents. Known primary aromatic amine developers can be used, including phenylenediamines such as 4-amino-N,N-diethylaniline, 3-methyl-4-amino-N,N-diethylaniline, 4-amino-N-ethyl-N-β-hydroxyethylaniline, 3-methyl-4-amino-N-ethyl-N-β-methanesulfonamidoethylaniline, and 4-amino-3-methyl-N-ethyl-N-β-methoxyethylaniline as color developing agents.

In addition, for example, the compounds described in L.F.A. Mason, *Photographic Processing Chemistry,* Focal Press Co., (1966), pages 226–229, U.S. Pat. Nos. 2,193,015, 2,592,364, and Japanese Patent Application (OPI) No. 64933/73 can be used.

These color developers can further contain pH buffers such as alkali metal sulfites, carbonates, borates and phosphates, development inhibitors or antifoggants such as bromides, iodides and organic antifoggants, and so forth. If desired, the developers may contain water-softening agents, preservatives such as hydroxylamine, organic solvents such as benzyl alcohol and diethylene glycol, development accelerators such as polyethylene glycol, quaternary ammonium salts, and amines, dye-forming couplers, competitive couplers, fogging agents such as sodium borohydride, auxiliary developing agents such as 1-phenyl-3-pyrazolidone, tackifiers, polycarboxylic acid-based chelating agents as described in U.S. Pat. No. 4,083,723, antioxidants as described in West German Patent Laid-Open (OLS) No. 2,622,950, and so forth.

After color development, the photographic emulsion layer is usually bleached. This bleaching may be performed simultaneously with fixing, or bleaching and fixing may be performed separately. Bleaching agents which can be used include polyvalent metal (e.g., iron (III), cobalt (III), chromium (VI) and copper (II)) compounds, peracids, quinones, and nitroso compounds. More specifically, for example, ferricyanides, dichromates, organic acid salts or iron (III) or cobalt (III), such as complex salts with aminopolycarboxylic acids (e.g., ethylenediaminetetraacetic acid, nitrirotriacetic acid, and 1,3-diamino-2-propanoltetraacetic acid) or organic acids (e.g., citric acid, tartaric acid, and malic acid), persulfates, permanganates, and nitrosophenol can be used. Of these compounds, potassium ferricyanide, iron (III) sodium ethylenediaminetetraacetate, and iron (III) ammonium ethylenediaminetetraacetate are particularly useful. Ethylenediaminetetraacetic acid/iron (III) complex salts are useful in both a separate bleaching solution and a combined bleach-fixing solution.

To the bleaching or bleach-fixing solution, as well as bleach accelerators as described in U.S. Pat. Nos. 3,042,520, 3,241,966, Japanese Patent Puablication Nos. 8506/70 and 8836/70 and thiol compounds as described in Japanese Patent Application (OPI) No. 65732/78, various additives can be added.

When the light-sensitive material of the present invention is used in the diffusion transfer process, it can be processed with viscous developers.

Suitable viscous developers are liquid compositions containing the components necessary for developing silver halide emulsions and for forming diffusion transfer dye images. The solvent used is composed mainly of water and sometimes contains hydrophilic solvents such as methanol and methyl Cellosolve. The processing composition contains sufficient amounts of alkalis to maintain the necessary pH level to cause development of emulsion layers and also to nuetralize acids (e.g., hydrohalogenic acids such as hydrobromic acid and carboxylic acids such as acetic acid) formed during the processes of development and dye image formation. Alkalis which can be used include lithium hydroxide, sodium hydroxide, potassium hydroxide, calcium hydroxide dispersions, hydroxytetramethyl ammonium, sodium carbonate, trisodium phosphate, alkali metal or alkaline earth metal salts of diethylamines, etc., and amines. It is desirable for caustic alkali to be present in such a concentration that the pH at room temperature is at least 12, preferably at least about 14. More preferably the processing solution contains high molecular weight hydrophilic polymers such as polyvinyl alcohol, hydroxyethyl cellulose and sodium carboxymethyl cellulose. It is preferred for these polymers to be present in an amount such that the viscosity at room temperature of the resulting composition is 1 poise or more, especially from several hundred (500 to 600) to 1,000 poises.

The present invention is explained in greater detail by reference to the following examples.

EXAMPLE 1

Film A

The following layers were coated on a polyethylene double-coated baryta paper support in the order listed.

First Layer: a blue-sensitive silver chlorobromide emulsion layer of a thickness of 3.0 $\mu$ containing a yellow coupler, α-pivaloyl-α-(2,4-dioxo-5,5'-dimethyloxazolidine-3-yl)-2-chloro-5-[α-(2,4-di-tert-pentylphenoxy)butaneamido]acetoanilide (amount of coupler coated: $0.646\times10^{-3}$ mol/m$^2$; amount of silver coated: $3.88\times10^{-3}$ mol/m$^2$; silver bromide: 70 mol %; silver chloride: 30 mol %).

Second Layer: a gelatin layer of a thickness of 1.5 $\mu$.

Third Layer: a gelatin layer of a thickness of 3.1 $\mu$ containing a magenta coupler, 1-(2,4,6-trichlorophenyl)-3-[2-chloro-(5-tetradecaneamido)anilino]-5-pyrazolone (amount of coupler coated: $0.500\times10^{-3}$ mol/m$^2$).

Film B

This film was prepared in the same manner as in the preparation of Film A except that the Second layer further contained 2,5-dioctylhydroquinone (amount of hydroquinone coated: $1.59\times10^{-4}$ mol/m$^2$).

Film C

This film was prepared in the same manner as in the preparation of Film A except that the Second Layer further contained Compound (1) of the present invention ($1.59\times10^{-4}$ mol/m$^2$).

Film D

This film was prepared in the same manner as in the preparation of Film A except that the Second Layer further contained Compound (3) of the present invention ($1.59\times10^{-4}$ mol/m$^2$).

Film E

This film was prepared in the same manner as in the preparation of Film A except that the Second Layer further contained Compound (3) of the present invention ($8.0\times10^{-5}$ mol/m$^2$).

Film F

This film was prepared in the same manner as in the preparation of Film A except that the Second Layer further contained Compound (18) of the present invention ($8.0\times10^{-5}$ mol/m$^2$).

Films A to E as prepared above were each exposed to light through a wedge changing continuously in gray density and then subjected to the following processing:

| | Time (min) | Temperature (°C.) |
|---|---|---|
| Color Development | 3.5 | 33 |
| Bleach-fixing | 1.5 | 33 |
| Rinsing | 3 | 28–35 |

The compositions of the solutions used in the above steps were as follows:

| | |
|---|---|
| Color Developer | |
| Benzyl Alcohol | 15 ml |
| Diethylenetriaminepentaacetate | 5 g |
| KBr | 0.4 g |
| $Na_2SO_3$ | 5 g |
| $Na_2CO_3$ | 30 g |
| Hydroxyamine Sulfate | 2 g |
| 4-Amino-3-methyl-N—β-(methanesulfonamido)-ethylaniline $3/2H_2SO_4$ $H_2O$ | 4.5 g |
| Water to make | 1000 ml |
| pH | 10.1 |
| Bleach-Fixer | |
| Ammonium Thiosulfate (70 wt % aq. soln) | 150 ml |
| $Na_2SO_3$ | 5 g |
| Na[Fe(EDTA)] | 40 g |
| Water to make | 1000 ml |
| pH | 6.8 |

The density (magenta color density) of each developed sample was measured using a green filter. Magenta color mixing at yellow-colored areas was examined by measuring the difference between the magenta density at the maximum yellow color density and that at the minimum yellow color density.

The results obtained are shown in Table 1 below.

TABLE 1

| Film No. | Compound Used | Amount (mol/m$^2$) | Color Mixing |
|---|---|---|---|
| A (control) | — | — | 0.73 |
| B (comparison) | 2,5-Di-tert-octylhydroquinone | $1.59\times10^{-4}$ | 0.25 |
| C | Compound (1) | " | 0.19 |
| D | Compound (3) | " | 0.18 |
| E | Compound (3) | $8.0\times10^{-5}$ | 0.22 |
| F | Compound (18) | " | 0.22 |

The smaller the figure in the column "Color Mixing", the less color mixing occurs. It is apparent from these results that the compounds of the present invention are superior in preventing the formation of color stain and that a sufficiently satisfactory effect can be obtained even when they are used in small amounts.

EXAMPLE 2

Film A

A blue-sensitive silver chlorobromide emulsion layer containing a yellow coupler, α-pivaloyl-α-(2,4-dioxo-5,5'-dimethyloxazolidine-3-yl)-2-chloro-5-[α-(2,4-di-tert-pentylphenoxy)butyneamido]acetoanilide, was coated on a polyethylene double-coated baryta paper support in a thickness of 3 μ (amount of the coupler coated: $0.646\times10^{-3}$ mol/m$^2$; amount of silver coated: $3.88\times10^{-3}$ mol/m$^2$; silver bromide: 70 mol%, silver chloride: 30 mol%), and a gelatin layer was coated thereon in a thickness of 1 μ.

Films B to E

Films B to E were prepared in the same manner as in the preparation of Film A except that Compounds (1), (3), (6) and (8), respectively, used in the present invention were added to the above yellow coupler each in an amount of $0.02\times10^{-3}$ mol/m$^2$.

Each film was exposed to light through a wedge changing continuously in gray density and, thereafter, was processed in the same manner as in Example 1 except that the color development was performed at 38° C. for 3 minutes. After the processing, the yellow density was measured to determine the maximum density (Dmax) and the minimum density (Dmin).

The results obtained are shown in Table 2 below.

TABLE 2

| Film No. | Compound Used | Dmax | Dmin |
|---|---|---|---|
| A (control) | — | 2.13 | 0.25 |
| B | (1) | 2.03 | 0.21 |
| C | (3) | 2.04 | 0.20 |
| D | (6) | 2.07 | 0.22 |
| E | (8) | 2.07 | 0.21 |

It can be seen from the results in Table 2 that Films B to E containing the compounds of the present invention have lower minimum density and are more improved in color fog than Film A (control).

Films A to E, prior to exposure to light, were stored for 3 days under conditions of a relative humidity of 50% and a temperature of 50° C. Thereafter, they were exposed to light and processed in the same manner as above. In Film A, a reduction in the maximum density and an increase in the minimum density were observed. On the other hand, in Films B to E, only very small changes in both the maximum density and the minimum density were observed.

EXAMPLE 3

Film A

This film sample was prepared by coating the following emulsion and auxiliary layers on a triacetyl cellulose support. First Layer (Low-Sensitivity Red-Sensitive Emulsion Layer)

A cyan coupler, 2-(heptafluorobutylamido)-5-[2'-(2'',4''-di-tert-aminophenoxy)butylamido]phenol (100 g), was dissolved in 100 ml of tricresyl phosphate and 100 ml of ethyl acetate and then emulsified in 1 kg of a 10% aqueous gelatin solution to prepare an emulsion. Subsequently, 500 g of the emulsion and 1 kg of a red-sensitive silver iodobromide emulsion (containing 70 g of silver and 60 g of gelatin; iodine content: 4.5 mol%) were mixed and then coated in a dry film thickness of 2 μ.

Second Layer (High-Sensitivity Red-Sensitive Emulsion Layer)

The same cyan coupler as used in the preparation of the First Layer (1,000 g) was mixed with 1 kg of a high sensitivity red-sensitive silver iodobromide emulsion (containing 70 g of silver and 60 g of gelatin; iodine content: 4.5 mol%), and the resulting mixture was coated in a dry film thickness of 2 μ.

Third Layer (Intermediate Layer)

2,5-Di-tert-octylhydroquinone (50 g) was dissolved in 100 ml of dibutyl phthalate and 100 ml of ethyl acetate and then emulsified in 1 kg of a 10% aqueous gelatin solution to prepare an emulsion. Subsequently, 700 g of the emulsion and 1 kg of 10% gelatin were mixed and then coated in a dry film thickness of 1.2 μ.

Fourth Layer (Low-Sensitivity Green-sensitive Emulsion Layer)

An emulsion was prepared in the same manner as in the preparation of the First Layer except that 125 g of a magenta coupler, 1-(2,4,6-trichlorophenyl)-3-[3-(2,4-di-tert-amylphenoxyacetamido)benzamido]-5-pyrazolone was used. Then, 500 g of the emulsion and 1 kg of a green-sensitive silver iodobromide emulsion (containing 70 g of silver and 60 g of gelatin; iodine content: 2.5 mol%) were mixed and coated in a dry film thickness of 2.0 μ.

Fifth Layer (High-Sensitivity Green-Sensitive Emulsion Layer)

The same magenta coupler emulsion as used in the preparation of the Fourth Layer (1,000 g) was mixed with 1 kg of a high sensitivity green-sensitive silver iodobromide emulsion (containing 70 g of silver and 60 g of gelatin; iodine content: 2.5 mol%) and then coated in a dry film thickness of 2 μ.

Sixth Layer (Intermediate Layer)

The same emulsion as used in the preparation of the Third Layer (700 g) was mixed with 1 kg of 10% gelatin and then coated in a dry film thickness of 0.9 μ.

Seventh Layer (Yellow Filter Layer)

A gelatin solution containing yellow colloidal silver was coated in a dry film thickness of 1 μ.

Eighth Layer (Low-Sensitivity Blue-Sensitive Emulsion Layer)

An emulsion was prepared in the same manner as in the preparation of the emulsion of the First Layer except that 70 g of a yellow coupler, α-pivaloyl-α-(1-benzyl-5-ethoxy-3-hydantoyl)-2-chloro-5-dodecyloxycarbonylacetoanilide was used. Then, 800 g of the emulsion and 1 kg of a blue-sensitive silver iodobromide emulsion (containing 70 g of silver and 60 g of gelatin; iodine content: 2.5 mol%) and then coated in a dry film thickness of 2.0 μ.

Ninth Layer (High-Sensitivity Blue-Sensitive Emulsion Layer)

The same emulsion as used in the preparation of the Eighth Layer (1,000 g) was mixed with 1 kg of a high sensitivity blue-sensitive emulsion layer (containing 70 g of silver and 60 g of gelatin; iodine content: 2.5 mol%) and then coated in a dry film thickness of 2.0 μ.

Tenth Layer (Second Protective Layer)

The same emulsion as used in the preparation of the Third Layer (1 kg) was mixed with 1 kg of 10% gelatin and then coated in a dry film thickness of 1 μ.

Eleventh Layer (First Protective Layer)

A 10% aqueous gelatin solution containing finely divided silver iodobromide emulsion (grain size: 0.15 μ; iodine content: 1 mol%) which had not been chemically sensitized was coated in such a manner that the amount of silver coated was 0.3 g/m$^2$ and the dry film thickness was 1 μ.

Films B and C

Films B and C were prepared in the same manner as in the preparation of Film A except that in the Third Layer, Sixth layer and Tenth Layer, di-tert-octylhydroquinone was replaced by Compounds (1) and (3), respectively, of the present invention.

Films A to C were exposed to red light through a wedge changing continuously in gray density and then subjected to the following reversal development processing:

| Step | Time (min) | Temperarure (°C.) |
|---|---|---|
| First Development | 6 | 38 |
| Rinsing | 2 | " |
| Reversal | 2 | " |
| Color Development | 6 | " |
| Adjustment | 2 | " |
| Bleaching | 6 | " |
| Fixing | 4 | " |
| Rinsing | 4 | " |
| Stabilization | 1 | ordinary temperature |

Drying

The compositions of the solutions used in each of the above steps was as follows;

| | |
|---|---|
| First Developer | |
| Water | 700 ml |
| Sodium Tetrapolyphosphate | 2 g |
| Sodium Sulfite | 20 g |
| Hydroquinone Monosulfonate | 30 g |
| Sodium Carbonate (monohydrate) | 30 g |
| 1-Phenyl-4-methyl-4-hydroxymethyl-3-pyrazolidone | 2 g |
| Potassium Bromide | 2.5 g |
| Potassium Thiocyanate | 1.2 g |
| Potassium Iodide (0.1% solution) | 2 ml |
| Water to make | 1000 ml |
| pH | 10.1 |
| Reversal Solution | |
| Water | 700 ml |
| Nitrilo-N,N,N—trimethylenephosponic acid.6Na salt | 3 g |
| Stannous Chloride (dihydrate) | 1 g |
| p-Aminophenol | 0.1 g |
| Sodium Hydroxide | 8 g |
| Glacial Acetic Acid | 15 ml |
| Water to make | 1000 ml |
| Color Developer | |
| Water | 700 ml |
| Sodium Tetrapolyphosphate | 2 g |
| Sodium Sulfite | 7 g |
| Sodium Triphosphate (12 hydrate) | 36 g |
| Potassium Bromide | 1 g |
| Potassium Iodide (0.1% solution) | 90 ml |
| Sodium Hydroxide | 3 g |
| Citrazinic Acid | 15 g |

-continued

| | |
|---|---|
| N—ethyl-N—β-(methanesulfonamidoethyl)-3-methyl-4-aminoaniline Sulfate | 11 g |
| Ethylenediamine | 3 g |
| Water to make | 1000 ml |
| Adjusting Solution | |
| Water | 700 ml |
| Sodium Sulfite | 12 g |
| Sodium Ethylenediaminetetraacetate (dihydrate) | 8 g |
| Thioglycerine | 0.4 ml |
| Glacial Acetic Acid | 3 ml |
| Water to make | 1000 ml |
| Bleaching Solution | |
| Water | 800 ml |
| Sodium Ethylenediaminetetraacetate (dihydrate) | 2.0 g |
| Iron (III) Ammonium Ethylenediamine-tetraacetate (dihydrate) | 120.0 g |
| Potassium Bromide | 100.0 g |
| Water to make | 1000 ml |
| Fixer | |
| Water | 800 ml |
| Ammonium Thiosulfate | 80.0 g |
| Sodium Sulfite | 5.0 g |
| Sodium Bisulfite | 5.0 g |
| Water to make | 1000 ml |
| Stabilizer | |
| Water | 800 ml |
| Formaldehyde (37% aq. soln) | 5.0 ml |
| Fuji Drywell (Surfactant produced by Fuji Photo Film Co., Ltd.; Registered Trade Name) | 5.0 ml |
| Water to make | 1000 ml |

The density of each developed film was measured using a red filter to determine the maximum color density (Dmax) and the minimum color density (Dmin). Moreover, the maximum color densities of the blue-sensitive layer and the green sensitive layer of each developed film was measured using a blue filter and a green filter, respectively.

The results obtained are shown in Table 3 below.

TABLE 3

| Film | Red-Sensitive Layer | | Green-Sensitive Layer | Blue-Sensitive Layer |
|---|---|---|---|---|
| No. | Dmax | Dmin | Dmax | Dmax |
| A | 2.98 | 0.43 | 2.63 | 2.85 |
| B | 2.82 | 0.40 | 2.61 | 2.78 |
| C | 2.83 | 0.40 | 2.58 | 2.81 |

It can be seen from the results in Table 3 that when the compounds of the present invention are present, the minimum density of the red-sensitive layer decreases. This demonstrates that the compounds of the present invention prevent the formation of color stain.

EXAMPLE 4

A multilayer color (negative) light-sensitive material was prepared by coating the following layers on a cellulose triacetate film support.

First-Layer (antihalation Layer)

Dry film thickness: 2.0 μ.

Second Layer (Low-Sensitivity Red-Sensitive Emulsion Layer)

A mixture of 400 g of Emulsion (1) containing a cyan coupler as shown below (containing 70 g of the cyan coupler and 100 g of gelatin), 200 g of Emulsion (2) containing the same coupler as used above and a DIR compound as shown below (containing 70 g of the cyan coupler, 10 g of the DIR compounds, and 100 g of gelatin), 200 ml of a 2% aqueous solution of a colored cyan coupler as shown below, and 1 kg of a low-sensitivity red-sensitive silver iodobromide emulsion (containing 100 g of silver halide and 70 g of gelatin; iodine content: 5.0 mol%) was prepared and then coated in a dry film thickness of 3.5 μ.

Cyan Coupler

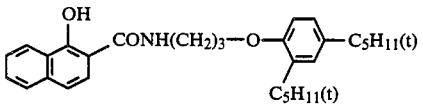

DIR Compound

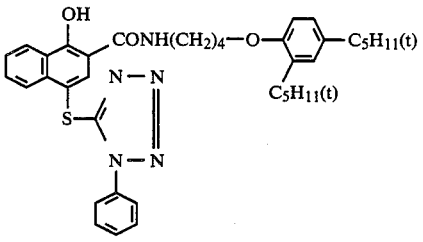

Colored Cyan Coupler

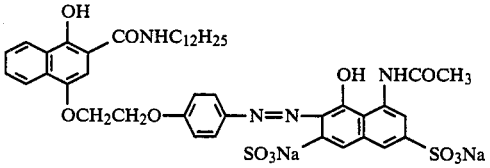

Third Layer (High-Sensitivity Red-Sensitive Emulsion Layer)

A mixture of 220 g of Emulsion (1), 30 g of Emulsion (2), Emulsions (1) and (2) as used in the Second Layer, 200 ml of a 2% aqueous colored cyan coupler solution, and 1 k of a high-sensitivity red-sensitive silver iodobromide emulsion (containing 100 g of silver halide and 70 g of gelatin; iodine content: 5 mol%) was prepared and then coated in a dry film thickness of 2.2 μ.

Fourth Layer (Gelatin Layer)

2,5-Di-tert-octylhydroquinone (50g) was dissolved in 100 ml of dibutyl phthalate and 100 ml of ethyl acetate, and then emulsified in 1 kg of a 10% aqueous gelatin solution to prepare an emulsion. Then, 700 g of the emulsion was mixed with 1 kg of a 10% aqueous solution of gelatin and coated in a dry film thickness of 1.2 μ.

Fifth Layer (Low-Sensitivity Green-Sensitive Emulsion Layer)

A mixture of 320 g of Emulsion (3) (containing 100 g of gelatin) containing 50 g of a magenta coupler as shown below and 10 g of a colored magenta coupler as shown below, 180 g of Emulsion (4) (containing 100 g of gelatin) containing 50 g of the same magenta coupler as shown below, 10 g of the same colored magenta coupler as shown below, and 15 g of a DIR compound as shown below, and 1 kg of a low-sensitivity green-sensitive silver iodobromide emulsion (containing 100 g of silver halide and 70 g of gelatin; iodine content: 5 mol %) was prepared and then coated in a dry film thickness of 3.2μ.

Magenta Coupler

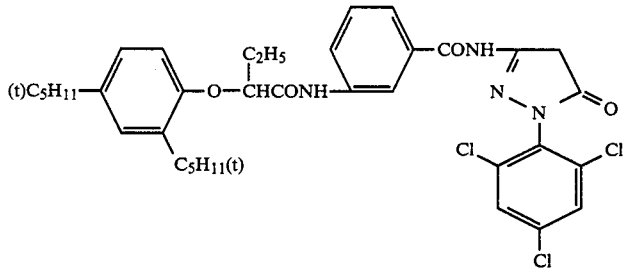

Colored Magenta Coupler

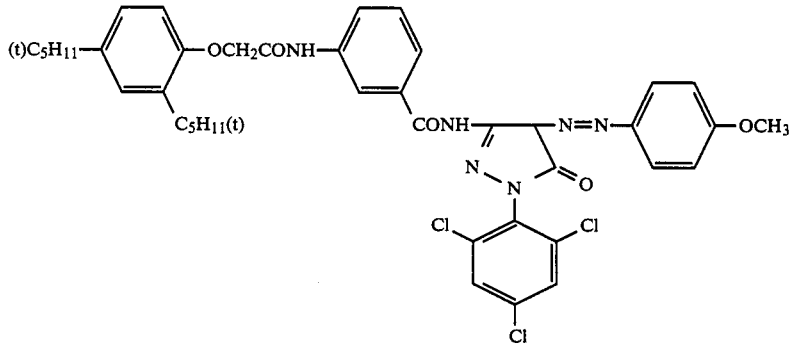

DIR Compound

-continued

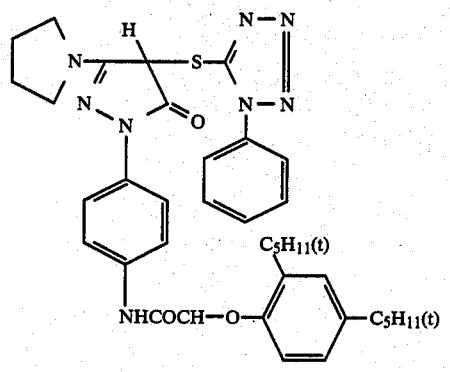

Sixth Layer (High-Sensitivity Green-Sensitive Emulsion Layer)

A mixture of 150 g of Emulsion (3), 30 g of Emulsion (4), Emulsions (3) and (4) as used in the Second Layer, and 1 kg of a high-sensitivity green-sensitive silver iodobromide emulsion (containing 100 g of silver halide and 70 g of gelatin; iodine content: 5 mol %) was prepared and then coated in a dry film thickness of 2.2μ.

Seventh Layer (Gelatin Intermediate Layer)

An aqueous gelatin solution was coated in a dry film thickness of 0.9μ.

Eighth Layer (Yellow Filter Layer)

A gelatin solution containing yellow colloidal silver was coated in a dry film thickness of 1μ.

Ninth Layer (Low-Sensitivity Blue-Sensitive Emulsion Layer)

Emulsion (5) of a yellow coupler as shown below (containing 100 g of the yellow coupler and 100 g of gelatin) (150 g) was added to 1 kg of a low-sensitivity blue-sensitive silver iodobromide emulsion (containing 100 g of silver halide and 70 g of gelatin; iodine content: 5 mol %), and the resulting mixture was then coated in a dry film thickness of 3.0μ.

Yellow Coupler

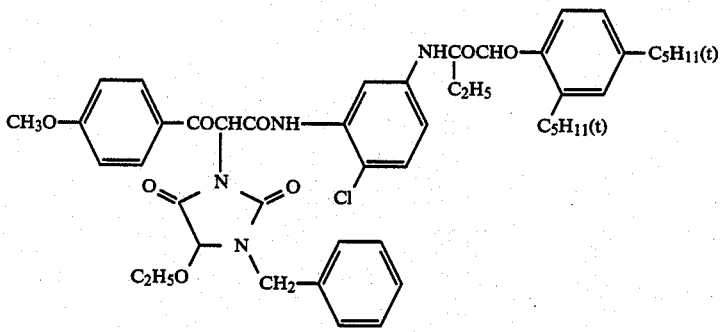

Tenth Layer (High-Sensitivity Blue-Sensitive Emulsion Layer)

Emulsion (5) as used in the Ninth Layer (300 g) was mixed with 1 kg of a high-sensitivity blue-sensitive silver iodobromide emulsion (containing 100 g of silver halide and 70 g of gelatin; iodine content: 5 mol %) and then coated in a dry film thickness of 2.5μ.

Eleventh Layer (Second Protective Layer)

Dry film thickness: 1μ.

Twelfth Layer (Gelatin Protective Layer)

Dry film thickness: 1.5μ.

This film sample is designated Film A.

Film B was prepared in the same manner as above except that in the preparation of the emulsion of the Fourth Layer, 2,5-di-tert-octylhydroquinone was replaced by Compound (1) of the present invention.

Films A and B were exposed to red light through a wedge changing continuously in gray density and then subjected to the following processing:

| Step | Time (min) |
|---|---|
| 1. Color Development | 3.25 |
| 2. Prebath | 0.5 |
| 3. Bleaching | 4⅓ |
| 4. Fixing | " |
| 5. Rinsing | 3.25 |
| 6. Stabilization | 0.5 |

The compositions of the solutions used in each of the above steps were as follows:

Color Developer

| | |
|---|---|
| Trisodium Nitrilotriacetate | 1.9 g |
| Sodium Sulfite | 4.0 g |
| Potassium Carbonate | 30.0 g |
| Potassium Bromide | 1.4 g |
| Potassium Iodide | 1.3 g |
| Hydroxylamine Sulfate | 2.4 g |
| 4-(N—ethyl-N—β-hydroxyethylamino)-2-methylaniline Sulfate | 4.5 g |
| Water to make | 1000 ml |

-continued

| | |
|---|---|
| pH | 10.0 |
| Bleaching Solution | |
| Iron (III) Ammonium Ethylenediamine-tetraacetate | 100.0 g |
| Disodium Ethylenediaminetetraacetate | 8.0 g |
| Ammonium Bromide | 150.0 g |
| Water to make | 1000 ml |
| pH | 6.0 |
| Fixer | |
| Sodium Tetrapolyphosphate | 2.0 g |
| Sodium Sulfite | 4.0 g |
| Ammonium Thiosulfate (70% aq. soln) | 175.0 ml |
| Sodium Bisulfite | 4.6 g |
| Water to make | 1000 ml |
| pH | 6.6 |
| Stabilizer | |
| Formaldehyde (40% aq. soln) | 8.0 ml |
| Water to make | 1000 ml |

The density of each developed film was measured using a green filter to determine the maximum and minimum color densities of the green-sensitive layer. It was found that Film B containing the compound used in the present invention had a lower magenta color density and prevented color mixing to a greater extent than Film A.

While the invention has been described in detail and with reference to specific embodiments thereof, it will be apparent to one skilled in the art that various changes and modifications can be made therein without departing from the spirit and scope thereof.

What is claimed is:

1. A silver halide color photographic light-sensitive material containing a compound represented by the general formula (II) as a color stain inhibitor

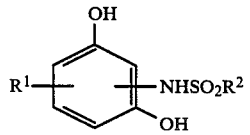

(II)

wherein:

$R^1$ is a hydrogen atom, a halogen atom, an alkyl group, an alkoxy group, an acylamino group, an alkylthio group, an alkoxycarbonyl group, an aryloxycarbonyl group, a sulfamoylamino group, a carbamoylamino group, an arysulfonamido group, an alkylsulfonamide group, an acyl group, a sulfonyl group, or a carbamoyl group each of which groups may be substituted; and $R^2$ is an alkyl group, an aryl group or an amino group which may be unsubstituted or substituted.

2. The silver halide color photographic light-sensitive material of claim 1, wherein $R^1$ is a hydrogen atom, an alkyl group, an acylamino group, an alkoxycarbonyl group, an aryloxycarbonyl group, a sulfamoylamino group, a carbamoylamino group, an acyl group, a sulfonyl group or a carbamoyl group.

3. The silver halide color photographic light-sensitive material of claim 1, wherein the $—NHSO_2R^2$ is substituted in the 6-position of the nucleus.

4. The silver halide color photographic light-sensitive material of claim 1, wherein the amount of said color stain inhibitor is $1.0\times10^{-3}$ to $1.0\times10^{-6}$ mole per square meter.

5. The silver halide color photographic light-sensitive material of claim 1, wherein $R^2$ is an amino group.

6. A silver halide color photographic light-sensitive material containing a color stain inhibitor which consists essentially of a compound represented by the general formula (IV)

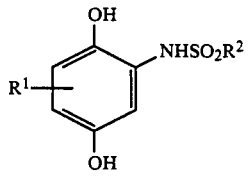

(IV)

wherein:

$R^1$ is a hydrogen atom, a halogen atom, an alkyl group, an alkoxy group, an acylamino group, an alkylthio group, an alkoxycarbonyl group, an aryloxycarbonyl group, a sulfamoylamino group, a carbamoylamino group, an acyl group, a sulfonyl group, or a carbamoyl group each of which groups may be substitited; and $R^2$ is an alkyl group, an aryl group or an amino group which may be unsubstituted or substituted.

7. The silver halide color photographic light-sensitive material of claim 6, wherein $R^1$ is a hydrogen atom, a halogen atom, an alkoxycarbonyl group, an aryloxycarbonyl group, an acyl group, a sulfonyl group or a carbamoyl group.

8. The silver halide color photographic light-sensitive material of claim 6, wherein the amount of said color stain inhibitor is $1.0\times10^{-3}$ to $1.0\times1^{-6}$ mole per square meter.

9. The silver halide color photographic light-sensitive material of claim 6, wherein $R^2$ is an amino group.

10. The silver halide color photographic light-sensitive material of claim 6, wherein the color stain inhibitor is a compound of formula (IV) only.

* * * * *